US006109981A

United States Patent [19]

Jin-ichi et al.

[11] Patent Number: 6,109,981

[45] Date of Patent: Aug. 29, 2000

[54] SOCKET CONTACT

[75] Inventors: Mashiyama Jin-ichi; Saitoh Yukio, both of Tokyo, Japan

[73] Assignee: DDK Ltd., Tokyo, Japan

[21] Appl. No.: 09/182,615

[22] Filed: Oct. 29, 1998

[30] Foreign Application Priority Data

Oct. 31, 1997 [JP] Japan ..... 9-316229

[51] Int. Cl.[7] ..... H01R 13/40

[52] U.S. Cl. ..... 439/733.1; 439/869; 439/752.5; 439/80

[58] Field of Search ..... 439/733.1, 869, 439/752.5, 79, 80, 636, 682, 856, 857

[56] References Cited

U.S. PATENT DOCUMENTS 3,083,345 3/1963 Scheller ..... 439/752.5
5,641,314 6/1997 Broschard, III et al. ..... 439/733.1
5,788,515 8/1998 Mitra et al. ..... 439/733.1

*Primary Examiner*—Paula Bradley
*Assistant Examiner*—Katrina Davis
*Attorney, Agent, or Firm*—Baker Botts L.L.P.

[57] ABSTRACT

A socket contact includes at its one end a connection portion to be connected to a board, at its center a fixing portion to be fixed to an insulator and at the other end two contact pieces having contact portions, respectively, for receiving therebetween a mating contact of a mating connector. The contact pieces are provided with recesses on the side of the fixing portion, respectively. A tongue having a width substantially equal to that of the fixing portion is provided. The tongue extends from the fixing portion toward the contact portions and is connected through a shank to the fixing portion. The tongue serves to prevent the socket contact from tilting in the insulator due to clearance therebetween so that the stable contact of the socket contact with the mating contact can be obtained and any damage of the socket contact can be prevented.

3 Claims, 6 Drawing Sheets

SOCKET CONTACT

BACKGROUND OF THE INVENTION

This invention relates to a socket contact for use in a female connector of paired electrical connectors used in an electronic appliances for connection between two boards.

A hitherto used socket contact will been explained by referring to FIGS. 3A and 3B and FIG. 4. FIG. 3A illustrates in a perspective view an electrical connector 40 using socket contacts of the prior art. FIG. 3B is a perspective view showing the socket contact 42 of the prior art. FIG. 4 is a sectional view of the socket contact 42 of the prior art fixed in the insertion aperture 16 of an insulator 12.

The electrical connector 40 is provided with fitting openings 18 for receiving mating contacts 34 on the opposite side of the connection portions 14 of the socket contacts 42 extending from the electrical connector 40.

In general, the electrical connector 40 mainly consists of an insulator 12 and socket contacts 42 or 421 as well-known. The insulator 12 is an electrically insulating plastic material and formed by the well-known injection molding technique or the like. The socket contact 42 is made of a metal and formed by the well-known press working or the like.

The socket contact 42 consists of three portions, that is, two contact pieces 28 having respective contact portions 32 adapted to contact a mating contact 34, a fixing portion 24 to be fixed to the insulator 12 and a connection portion 14 to be connected to a board 36 or the like. The two contact pieces 28 are arranged in face-to-face parallel relationship for receiving and embracing the mating contact 34 therebetween.

As shown in FIG. 3B the fixing portion 24 is formed with protrusions 26 serving as interference when the socket contact 10 is press-fitted in one direction into the insulator 12. The socket contact 42 is fixed in the insertion aperture 16 of the insulator 12 by press-fitting or the like as shown in FIG. 4. With regard to the relation between the insertion aperture 16 and the socket contact 42, the insertion aperture 16 is about 0.05 to 0.2 mm larger than the socket contact 42 so as to permit the socket contact 42 to be inserted into the insertion aperture 16.

Problems of the socket contact of the prior art will be explained by referring to FIGS. 5 and 6. FIG. 5 illustrates a step of inserting the mating contact 34 into the socket contact 42 fitted in the electrical connector 40 in the state that the connector 40 is mounted on a board 36. FIG. 6 illustrates a step of inserting the mating contact 34 into the socket contact 42 fitted in the electrical connector 40 in the state that the connector 40 is mounted on a board 36, when the fixing portion 24 of the socket contact 42 is too small, even if the clearance between the socket contact 42 and the insertion aperture 16 of the insulator 12 is small.

In the above case, there is clearance of the order of 0.05 to 0.2 mm between the socket contact 42 and the insertion aperture 16 of the insulator 12. Therefore, although there is no problem in the inserting direction, the contact points with the mating contact 34 may be shifted correspondingly to the clearance with respect to directions other than the inserting direction as shown in FIG. 5, as a result of which the stable contact with the mating contact 34 cannot be obtained. What is worse still, if the clearance is too large, there is a possibility of deformation of the socket contact when the mating contact is inserted thereinto. Once the socket contact has been deformed, it becomes necessary to exchange the electrical connector itself and/or the board 36 on which the electrical connector is mounted.

In view of the above fact, it has been proposed to provide clearance as small as possible. However, no matter how an attempt is made, clearance less than 0.05 mm cannot be obtained. In the event that the fixing portion 24 of the socket contact is only 1.7 mm in length as a guide, even if the clearance is less than 0.05 mm, the socket contact would be fixed in an inclined position as shown in FIG. 6, with the result that although there is no problem in the inserting direction, the contact points with the mating contact 34 may be shifted correspondingly to the inclined position with respect to directions other than the inserting direction similarly to the case shown in FIG. 5. Therefore, the stable contact with the mating contact 34 cannot be obtained and there is also a possibility of deformation of the socket contact when the mating contact 34 is inserted thereinto.

With the construction of the socket contact of the prior art, moreover, it is very difficult to bring the connector portion 14 of the socket contact into contact with a land 38 on a board 36, making it impossible to solder the connection portion 14 to the board when the electrical connector is mounted on the board, due to the positional shifting of the socket contact in the insertion aperture 16 of the insulator 12 as described above. The socket contact can be inclined in the insertion aperture as shown is FIG. 5 even if the clearance is of the order of 0.05 to 0.2 mm. Furthermore, it will be understood that once the socket contact has been deformed, there is the need to exchange the electrical connector itself or the board 36 itself on which the electrical connector is mounted.

SUMMARY OF THE INVENTION

It is an object of the invention to provide an improved socket contact which is able to position properly in an insertion aperture of an insulator without assuming an inclined position even if there is an amount of clearance between the socket contact and the insertion aperture, thereby obtaining stable contact with a mating contact and preventing the damage of the socket contact itself.

In a socket contact to be held and fixed in an insulator, including at its one end a connection portion to be connected to a board, substantially at its center a fixing portion to be fixed to said insulator, and at the other end two contact pieces arranged in parallel with each other and having contact portions to contact a mating contact, in order to accomplish the above object, according to the invention said contact pieces are provided with recesses on the side of said fixing portions, respectively, and a tongue having a width substantially equal to that of said fixing portion is provided, which extends from said fixing portion at its center toward said contact portions and is connected through a shank to said fixing portion.

The tongue has a width such that the difference between the widths of the tongue and the fixing portion is within ±0.1 mm. If the absolute value on the negative side of this range becomes larger, the clearance between the socket contact 10 and the insertion aperture 16 of the insulator 12 becomes too large to give rise to the state shown FIG. 5 or FIG. 6 so that the problem is not solved.

If the absolute value on the positive side of this range becomes larger, the tongue 20 will scratch the insulator when the socket contact 10 is being inserted into the insertion aperture 16 of the insulator 12. Therefore, the size of the tongue 20 is appropriately designed so as to prevent the socket contact 10 from tilting and the insulator 12 from being scratched.

Moreover, the tongue 20 and the shank 24 extend by 1 to 2.5 mm from the fixing portion. If the extending distance is not more than 1 mm, the socket contact 10 will assume an inclined position in the clearance between the socket contact and the insertion aperture 16 of the insulator 12 as shown in FIG. 6. On the other hand, if the extending distance is not less than 2.5 mm, the electrical connector will become large which is contradictory to the requirement for electrical connectors to be miniaturized, which has recently become stronger. Therefore, the extending distance of the tongue 20 from the fixing portion 24 is appropriately designed in consideration of the size of the connector, and the prevention of the mating contact 34 upon being inserted from contacting the tongue 20 and the socket contact from obliquely tilting and the like.

The socket contact comprising the above features according to the invention has the following significant effects.

Since the socket contact according to the invention comprises the tongue having a width which is substantially equal to that of the fixing portion of the socket contact, for example, the difference between the widths of the tongue and fixing portion being within ±0.1 mm, the socket contact 10 can be reliably guided into the insertion aperture 16 of the insulator 12 with the aid of the tongue 20.

As the socket contact according to the invention extends from the fixing portion, for example, by a distance of 1 to 2.5 mm, the socket contact 10 can be reliably guided into the insertion aperture 16 of the insulator 12 with the aid of the tongue 20.

The guidance of the tongue 20 of the socket contact 10 according to the invention will prevent the tilting of the socket contact 10 in all the directions including the inserting direction, so that when a mating contact 34 is fitted in the socket contact 10, the stable contact therebetween can be obtained without in any way damaging the socket contact 10.

Moreover, the guidance of the tongue 20 of the socket contact 10 according to the invention will prevent any positional shifting of the socket contact 10 caused by the clearance between the socket contact 10 and the insertion aperture 18 of the insulator 12 in all the directions including the inserting direction, so that when a mating contact 34 is fitted in the socket contact 10, the stable contact therebetween can be obtained without in any way damaging the socket contact 10.

Furthermore, the guidance of the tongue 20 of the socket contact 10 according to the invention will prevent any tilting and positional shifting of the socket contact 10 in all the directions including the inserting direction, the connection portion 14 of the socket contact 10 can be exactly brought into the position of a land 38 of a board 36 (refer to FIG. 5) when an electrical connector 1 is fixed to the board 36, so that the electrical connector 1 can be surely fixed to the board by soldering.

Since the damage of the socket contact 10 can be prevented when inserting the mating contact 34 according to the invention as described above, there is no need to exchange the electrical connector 1 itself and a board 36 on which the connector 1 is mounted, and therefore the operation cost does not increase.

The invention will be more fully understood by referring to the following detailed specification and claims taken in connection with the appended drawings.

DESCRIPTION OF THE PREFERRED EMBODIMENTS

Figure 1A:
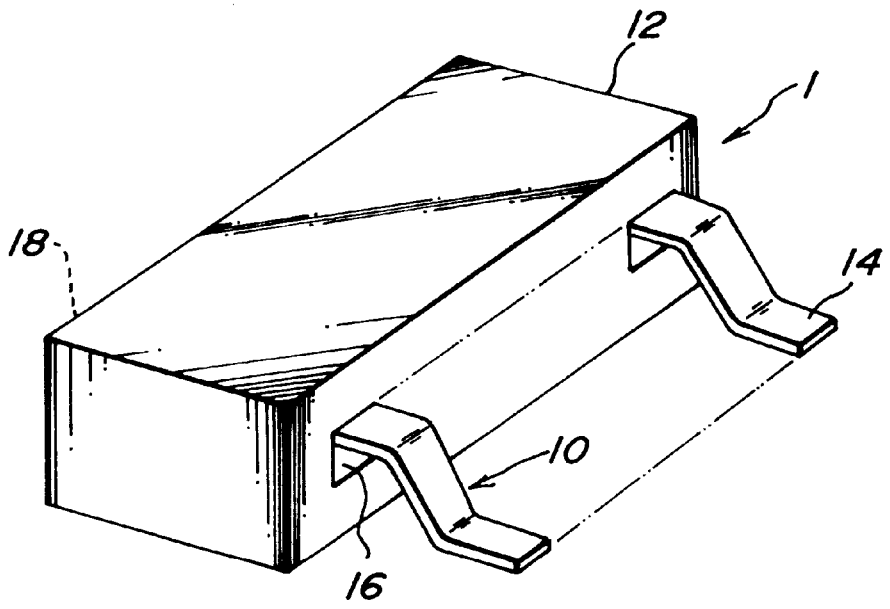
FIG. 1A is a perspective view of an electrical connector using socket cone according to the invention.
Figure 1B:
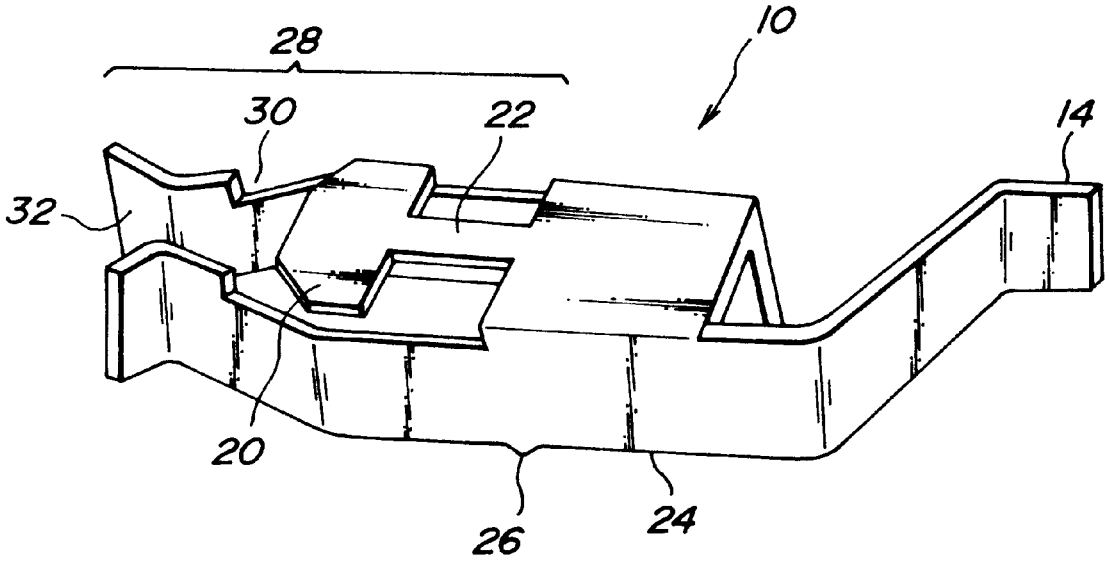
FIG. 1B is a perspective view of the socket contact according to the invention.
Figure 2:
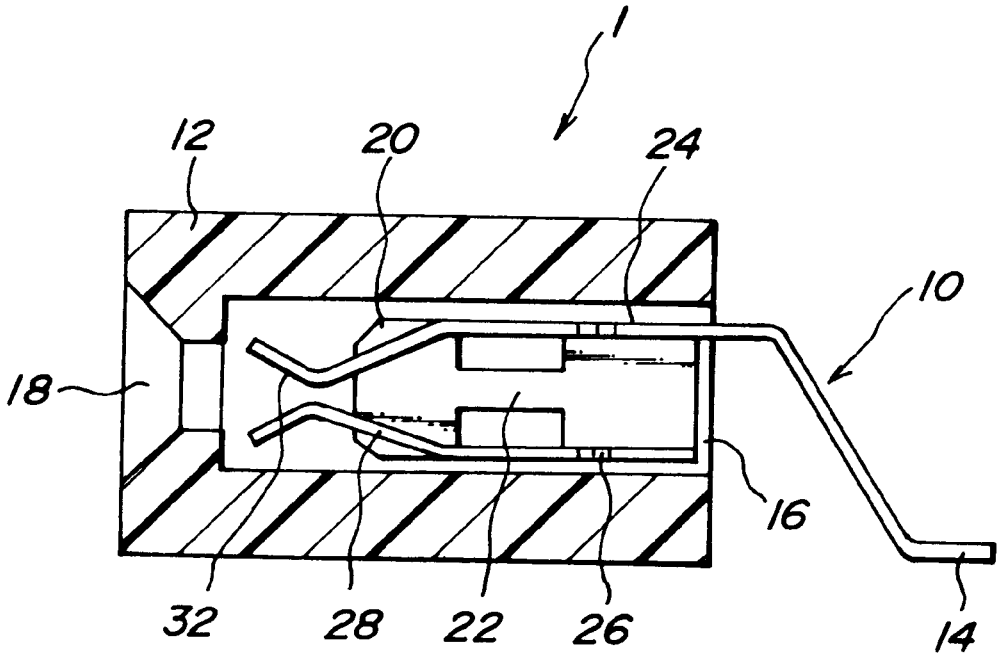
FIG. 2 is a sectional view of the socket contact according to the invention fixed in an insertion aperture of an insulator.
Figure 3A:
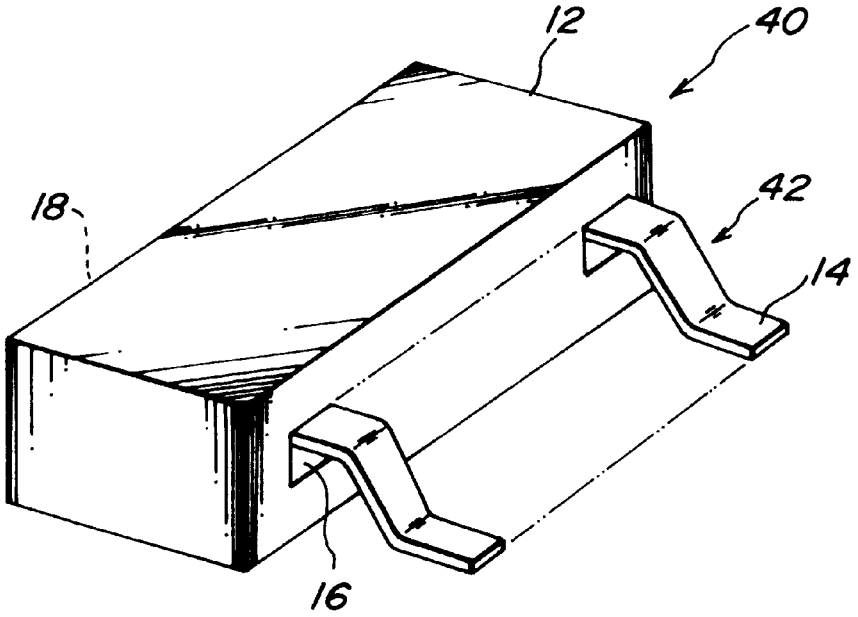
FIG 3A PRIOR ART
FIG. 3A is a perspective view of an electrical connector using socket of the prior art.
Figure 3B:
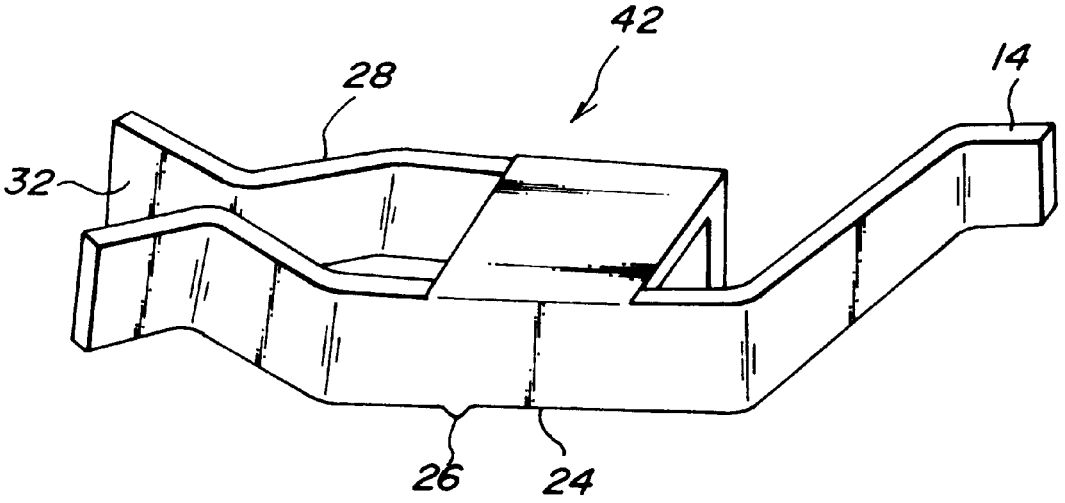
FIG 3B PRIOR ART
FIG. 3B is a perspective view of a socket contact of the prior art.
Figure 4:
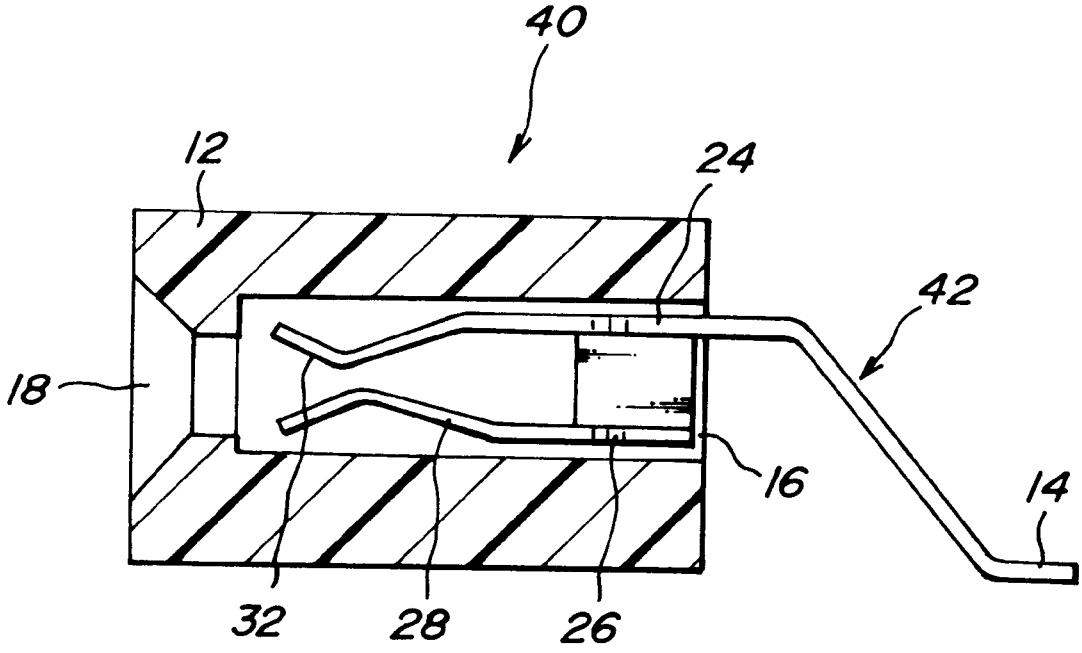
FIG. 4 PRIOR ART
FIG. 4 is a sectional view of the socket contact of the prior art fixed in an insertion aperture of an insulator.
Figure 5:
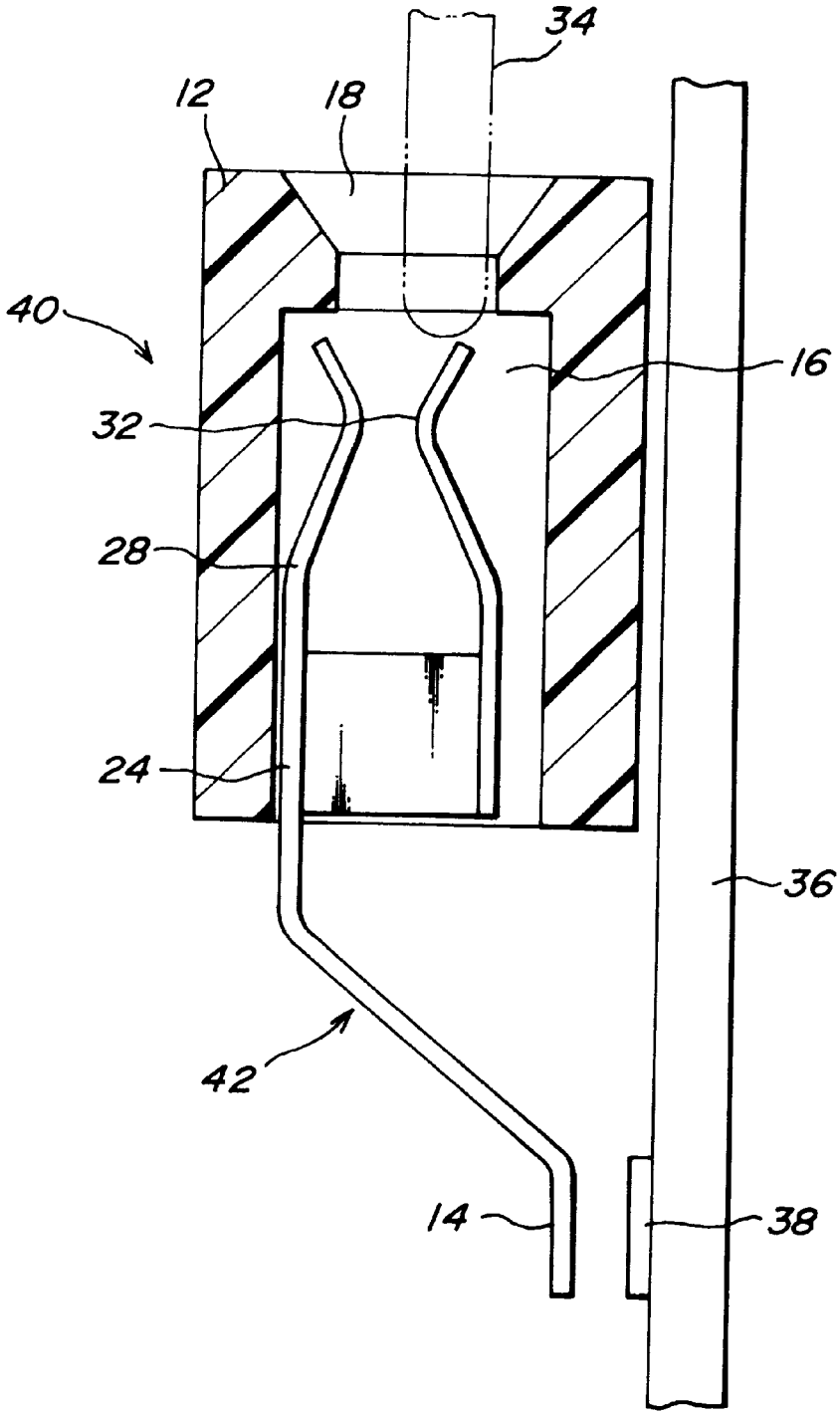
FIG. 5 PRIOR ART
FIG. 5 is a sectional view of the electrical connector using the socket contacts of the prior art for explaining the improper relation of the socket contact to a mating contact and a land on a board on which the connector is mounted.
Figure 6:
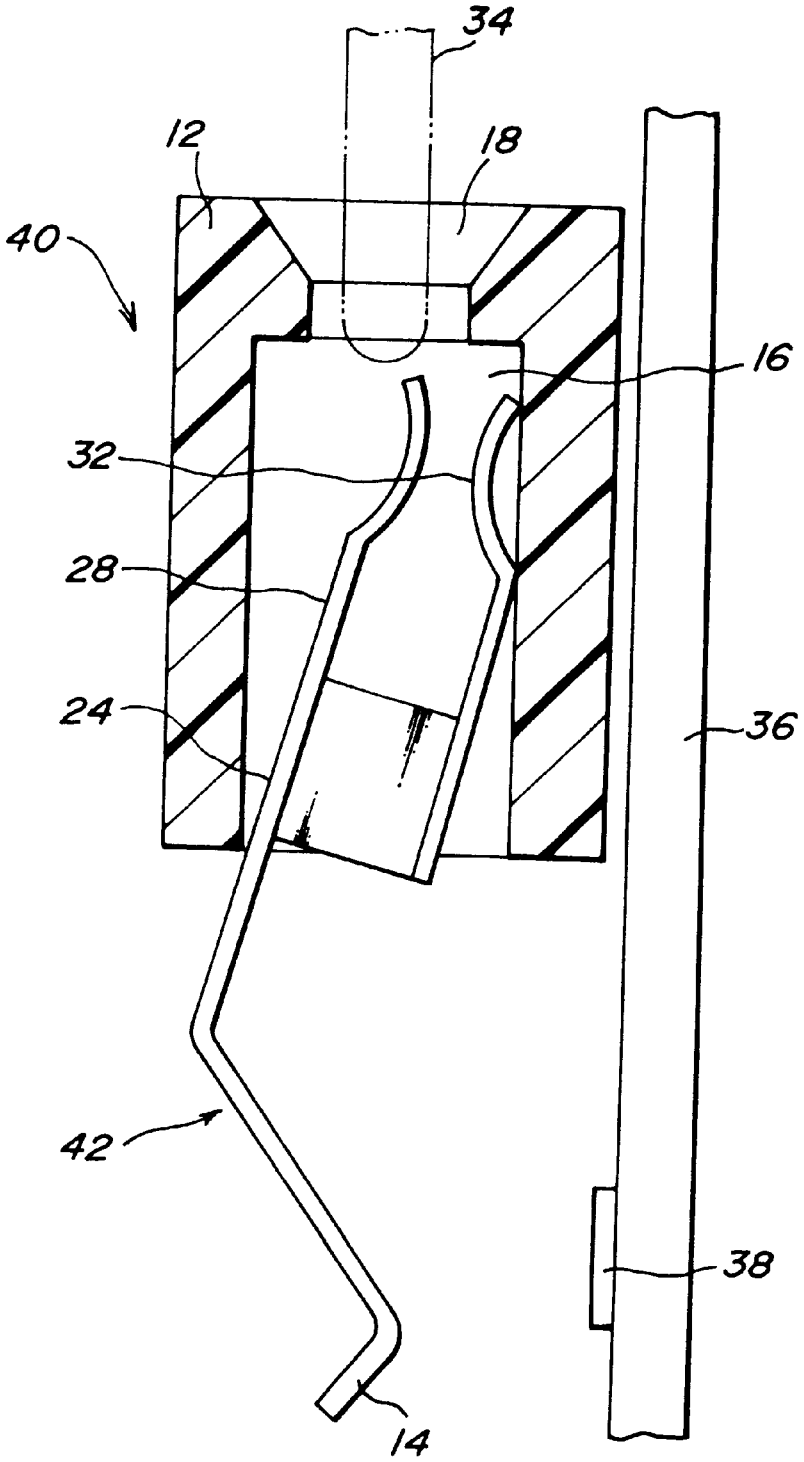
FIG. 6 PRIOR ART
FIG. 6 is a sectional view of the electrical connector using the socket contacts of the prior art with relatively large clearance between the tongue and the insertion aperture of the insulator for explaining the improper relation of the socket contact to a mating contact and a land on a board on which the connector is mounted.

The invention will be explained by referring to FIGS. 1A, 1B and 2. FIG. 1A illustrates an electrical connector 1 using socket contacts 10 according to the invention. FIG. 1B illustrates in a perspective view the socket contact according to the invention. FIG. 2 is a sectional view showing the socket contact 10 according to the invention fixed in an insertion aperture 16 of an insulator 12. The electrical connector 1 is provided with a fitting opening 18 for receiving a mating contact on the opposite side of the connection portion 14 of the socket contact 10 extending from the connector 1.

In general, an electrical connector 1 consists mainly of socket contacts 10 and an electrical insulator 12. The electrical connector 1 has a size over a wide range. The electrical connector 1 in the shown embodiment has a length of the order of 50 mm, a width of 8 mm and a height of 5 mm. This length varies depending on the pitch and the number of contacts. In the shown embodiment, the pitch of contacts is 2.54 mm and the number of contacts is 30. However, the pitch may vary from 1 to 2.54 mm and the number of contacts 10 to 100, depending on the desired functions and the like of the connector.

While the contact tail of the surface mounting type (referred to hereinafter as "SMT") is shown in the embodiment, it will be apparent that any other types may be used such as L-shaped dip type or straight dip type.

First, the socket contact according to the invention will be explained. The socket contact 10 comprises four portions, that is, a connection portion 14 to be connected to a board 36, a fixing portion 24 to be fixed to an insulator 12, contact pieces 28 having contact portions 32 adapted to contact a mating contact 34 of a mating connector (not shown) and a tongue 20 extending from the fixing portion 24.

The socket contact 10 is produced by the known press-forming and the like and is held and fixed in an insertion aperture 16 of the insulator 12. The materials which can be used in the socket contact 10 are phosphor bronze and beryllium copper which are superior in springiness. For the economic reason and in view of good workability, the phosphor bronze is better. The socket contact 10 has a length of 5.4 mm, a width of 1.6 mm and a height of 1.4 mm. This socket contact 10 is of a twin-contact type and its fixing portion has a U-shaped cross-section formed by bending.

Respective components of the socket contact 10 will be explained hereinafter. First, contact pieces 28 having contact portions 32 will be explained. The contact pieces 28 having contact portions 32 are two and arranged in face-to-face parallel relationship to embrace a mating contact 34. Each of the contact pieces has a free end provided with the contact portion 32 and another opposite end connected to the fixing portion 24. The two contact pieces 28 arranged in parallel relationship are folded at the fixing portion 24 inwardly substantially at right angles in a manner facing to each other. As a result, the fixing portion 24 has a substantially U-shaped cross-section. The distance between the two contact pieces 28 thus folded is appropriately designed in consideration of the contact pressure and the contact stability with a mating contact 34 and the miniaturization of connectors.

The contact portions 32 at the free ends of the contact pieces 28 are adapted to contact the mating contact 34. The contact portions 32 may have any shape so long as it can contact the mating contact 34. However, as the mating contact 34 is inserted into the socket contact 10, preferably the contact portions 32 are curved inwardly to prevent the mating contact 34 from contacting any portions other than the contact portions 32, so that the socket contact 10 contacts the mating contact 34 in point contact to obtain the stable contact therebetween. In addition, the inwardly curved contact portions 32 facilitate to guide the mating contact 34. Instead of curving the contact portions 32, these portions may be provided on the inwardly facing surfaces with inwardly extending protrusions or may be formed with a widely spread opening to facilitate the insertion of the mating contact 34.

As shown in FIG. 1B, the contact pieces 28 are provided with long recesses 30 extending from the end of the fixing portion 24 to the proximity of the contact portions 32. The recesses 30 provide clearance for preventing the contact pieces 28 from contacting the tongues 20. The size of the recesses 30 is appropriately designed in consideration of the strength and plate thickness of the socket contact 10, the function of the recesses 30 and the contact stability of the socket contact 10 with the mating contact 34. In the shown embodiment, the recesses 30 have a depth of 0.35 mm and a length longer by 0.1 to 0.5 mm than the total length of the tongue 20 including the shank 22.

The tongue 20 will then be explained, which is the subject feature of the present invention. The tongue 20 is connected to the fixing portion 24 by the shank 22 having a width narrower by at least 0.6 mm than the width of the tongue 20 in consideration of the working of the socket contact 10. The width of the shank 22 is appropriately designed in consideration of the strength of the shank 22 and the workability of the socket contact 10. In this embodiment, the width of the shank 22 is of the order of 0.9 mm.

The tongue 20 and the shank 22 extend in the direction the same as that the contact pieces 28 extend. The tongue 20 serves to prevent the socket contact 10 from tilting when the socket contact 10 has been inserted in the insertion aperture 16 of the insulator 12.

The tongue 20 may have any size so long as it can exhibit its function described above. The tongue 20 is appropriately designed in consideration of its function and the strength and workability of the socket contact 10. In view of its function, preferably, the tongue 20 has a width substantially equal to that of the fixing portion 24 and extends to the proximity of the contact portions 32. In the shown embodiment, the width of the tongue 20 is 1.6 mm substantially equal to that of the fixing portion 24 and the length of the tongue 20 including the shank 22 is of the order of 2.2 mm.

Similarly, the tongue 20 may have any shape so long as it can exhibit its function described above. The tongue 20 is appropriately designed in consideration of its function and the strength and workability of the socket contact 10. In the shown embodiment, the tongue 20 is substantially rectangular and chamfered at the free end comers in order to prevent the insulator 12 from being scratched by the tongue when the socket contact 10 is being inserted into the insertion aperture 16 of the insulator 12.

The fixing portion 24 of the socket contact 10 will be explained. The fixing portion 24 has the U-shaped cross-section and is provided at both the free ends of arms of the U-shape with protrusions 26 serving as interference when the socket contact 10 is press-fitted in the insertion aperture 16 of the insulator 12. The protrusions 26 may have any shape and size so long as they serve to fix the socket contact 10 to the insulator 12. The protrusions 26 are appropriately designed in consideration of the workability of the socket contact 10, the strength of the insulator 12 on inserting the socket contact, and the like. In the shown embodiment, the protrusions are triangular and have a height of the order of 0.15 mm. Although the protrusions for the press-fitting have been shown in the embodiment, it is to be understood that instead of the protrusions, lances may be provided for fixing the socket contact 10 to the insulator 12 with the lances biting the insulator 12.

Finally, the connection portion 14 will be explained. The connection portion 14 of the socket contact 10 is to be connected to a board or the like (not shown). While the connection portion of the surface mounting type (SMT) is shown in this embodiment, any other types may be used such as L-shaped dip type or straight dip type.

The insulator 12 is made of an electrically insulating plastic material and formed by the well-known molding technique for holding and fixing the socket contacts therein. Examples of such a material are PBT, 66PA, 46PA, PET, LCP, PPS and the like. For the economic reason and in view of good workability, the PPS is better.

The insulator 12 is provided with insertion apertures 16 into which the socket contacts 10 are inserted and is formed with fitting openings 18 into which mating contacts 34 are inserted as shown in FIG. 2. The inlets of the fitting openings 18 are tapered to facilitate to guide the mating contacts (FIG. 2).

While the invention has been particularly shown and described with reference to preferred embodiments thereof, it will be understood by those skilled in the art that the foregoing and other changes in form and details can be made therein without departing from the spirit and scope of the invention.

What is claimed is:

1. A socket contact adapted to be received and affixed in an insertion aperture in an insulator, comprising:

(a) a fixing portion of substantially "U"-shape in cross section having a base and a pair of opposed arms, the fixing portion having first and second ends and a width between the arms;

(b) a connection portion attached to and extending from the first end of the fixing portion for connecting the socket connector to a board;

(c) two contact pieces extending from the second end of the fixing portion, one contact piece being attached to one of the arms and the other contact piece being attached to the other of the arms, and each contact piece having a contact portion spaced apart from the fixing portion and adapted for contacting a mating contact of a mating connector; and (d) a tongue extending from the second end of the fixing portion, the tongue being connected by a shank to the base of the fixing portion, being coplanar with the base of the fixing portion, and having a width substantially equal to the width of the fixing portion; and wherein the contact pieces have recesses located abreast of the tongue such that the tongue does not engage the contact pieces and is engageable with walls of the insertion aperture of the insulator upon insertion of the socket contact into the insertion aperture so as to prevent side-to-side mis-alignment of the contact portions with the mating contact.

2. The socket contact as set forth in claim 1, wherein said tongue has a width such that the difference between the widths of said tongue and said fixing portion is within ±0.1 mm.

3. The socket contact as set forth in claim 1, wherein said tongue including the shank extends lengthwise from said fixing portion by a distance between 1.0 and 2.5 mm.

* * * * *

UNITED STATES PATENT AND TRADEMARK OFFICE

CERTIFICATE OF CORRECTION

PATENT NO. : 6,109,981
DATED : August 29, 2000
INVENTOR(S) : Mashiyama et al.

It is certified that error appears in the above-identified patent and that said Letters Patent is hereby corrected as shown below:

Title page,
Item [19], (Inventors): "Jin-ichi et al." should read -- Mashiyama et al.--
Item [75], Inventors: "Mashiyama Jin-ichi;" should read -- Jin-ichi Mashiyama; --;
And
"Saitoh Yukio," should read -- Yukio Saitoh, --

Signed and Sealed this

Thirteenth Day of November, 2001

*Attest:*

Nicholas P. Godici

NICHOLAS P. GODICI
*Acting Director of the United States Patent and Trademark Office*

*Attesting Officer*